United States Patent [19]

Edgar et al.

[11] 4,004,985

[45] Jan. 25, 1977

[54] SYSTEM FOR QUENCHING HOT COKE

[75] Inventors: William D. Edgar, Allison Park; John D. Sustarsic, McKees Rocks; Allan F. Adamsky, Washington, all of Pa.

[73] Assignee: Koppers Company, Inc., Pittsburgh, Pa.

[22] Filed: Sept. 13, 1974

[21] Appl. No.: 505,855

Related U.S. Application Data

[62] Division of Ser. No. 286,752, Sept. 5, 1972, abandoned.

[52] U.S. Cl. ..... 202/230; 202/263; 201/39; 214/18 R

[51] Int. Cl.[2] ..... C10B 39/12

[58] Field of Search ..... 201/39; 202/228, 227, 202/230, 262, 263, 95; 214/18

[56] References Cited

UNITED STATES PATENTS

| | | | |
|---|---|---|---|
| 3,580,813 | 5/1971 | Hinchliffe | 201/39 |
| 3,652,403 | 3/1972 | Knappstein et al. | 201/39 |
| 3,675,400 | 7/1972 | Kubsch | 202/227 |
| 3,676,305 | 7/1972 | Cremer | 202/227 |
| 3,839,161 | 10/1974 | Pries | 202/227 |
| 3,844,900 | 10/1974 | Schulte | 202/227 |
| 3,869,352 | 3/1975 | Allen et al. | 202/227 |

*Primary Examiner*—Wilbur L. Bascomb, Jr.
*Attorney, Agent, or Firm*—Sherman H. Barber; Oscar B. Brumback

[57] ABSTRACT

A quenching track extends alongside of and away from a coke oven battery, and coke receiving apparatus is movable on the track to a remote location at which supporting structure for the coke receiving apparatus is located. Associated with the supporting structure is conveyor means onto which incandescent coke is discharged from the coke receiving apparatus. Coke on the conveyor means is quenched, and vapors arising from the coke during quenching are conveyed to a stack and are discharged to the atmosphere. Fumes arising from the coke receiving means during discharging of the coke are withdrawn into a gas scrubber and cleaned therein. From the scrubber the cleaned fumes are discharged to the stack and to the atmosphere.

Various types of coke receiving means are disclosed, and various types of supporting means and arrangements of conveyors at the remote location are also disclosed.

4 Claims, 11 Drawing Figures

SYSTEM FOR QUENCHING HOT COKE

This is a division of application Ser. No. 286,752, filed Sept. 5, 1972 now abandoned.

BRIEF SUMMARY OF THE INVENTION

The invention relates to coke ovens and, more particularly, to novel wet or dry method and apparatus for quenching coke. In accordance with our invention, coke is pushed from a coke oven chamber through a fully enclosed coke guide with retractable hood section into a single-, or multiple-position hot coke transfer car that is enclosed by the retractable coke guide hood. The transfer car is connected to a fume collecting and cleaning system during the pushing phase and thereafter until the coke is quenched at a quenching station. The various systems shown and described hereinafter are adaptable to either wet or dry quenching.

For a further understanding of the invention and for features and advantages thereof, reference may be made to the following description and drawings which illustrate embodiments of equipment in accordance with the invention.

DETAILED DESCRIPTION

Figure 1:
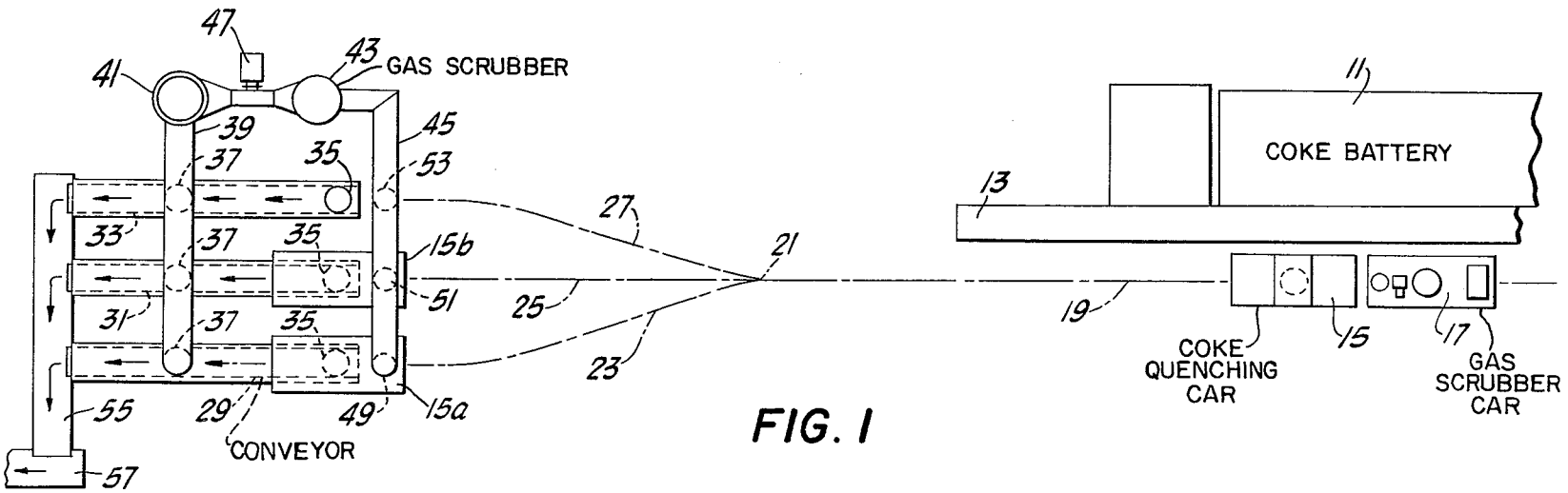
FIG. 1 is a schematic plan view of equipment in accordance with one embodiment of the invention.

Referring to FIG. 1, a portion of a conventional coke oven battery 11 is shown at the right hand side of the figure, and alongside a bench portion 13 of the battery 11, there is shown an enclosed coke quenching car 15 and a gas scrubber car 17 with traction drive. The enclosed quenching car 15 and the gas scrubber car 17 with traction drive are shown and described in copending application, Ser. No. 285,427, filed Aug. 31, 1972 and now U.S. Pat. No. 3,868,309.

The enclosed quenching car 15 and gas scrubber car 17 operate along a single track 19, which is co-extensive with the length of the coke oven battery 11 and which also extends toward the left, as viewed in FIG. 1, to a track switching point 21. At the switching point 21, at least three separate track sidings 23, 25, 27 extend toward a coke receiving and quenching area at which there are located three enclosed coke quenching conveyors 29, 31, 33 that are each located below track level in a pit. At one end of each enclosed coke quenching conveyor 29, 31, 33 there is an adjustable sleeve 35 that is adaptable for engaging the bottom of the enclosed quenching car 15 whereby incandescent coke is transferable from the car to the quench conveyor without causing environmental pollution.

At about the mid-length point of each enclosed quench conveyor 29, 31, 33, there is a tubular conduit connection 37 to a vapor collecting main 39 that carries vapors from the coke that is being cooled with water sprays (not shown) above each conveyor to a stack 41. The stack 41 is also in communication with a gas scrubber 43 which pulls gases from a fume main 45 by means of a motorized fan 47. The fume main 45 is in communication with each one of two quenching cars 15*a*, 15*b* located on track sidings 23, 25 by means of tubular conduits 49, 51. A similar conduit 53 is over track siding 27 also.

At the far left hand side of FIG. 1 there is shown schematically another conveyor 55 that receives and carries away quenched coke from each one of the conveyors 29, 31, 33 and that transfers such coke to another take-away conveyor 57. The conveyor 57 is about at track level and the coke on it is conveyed to storage elsewhere.

Figure 2:
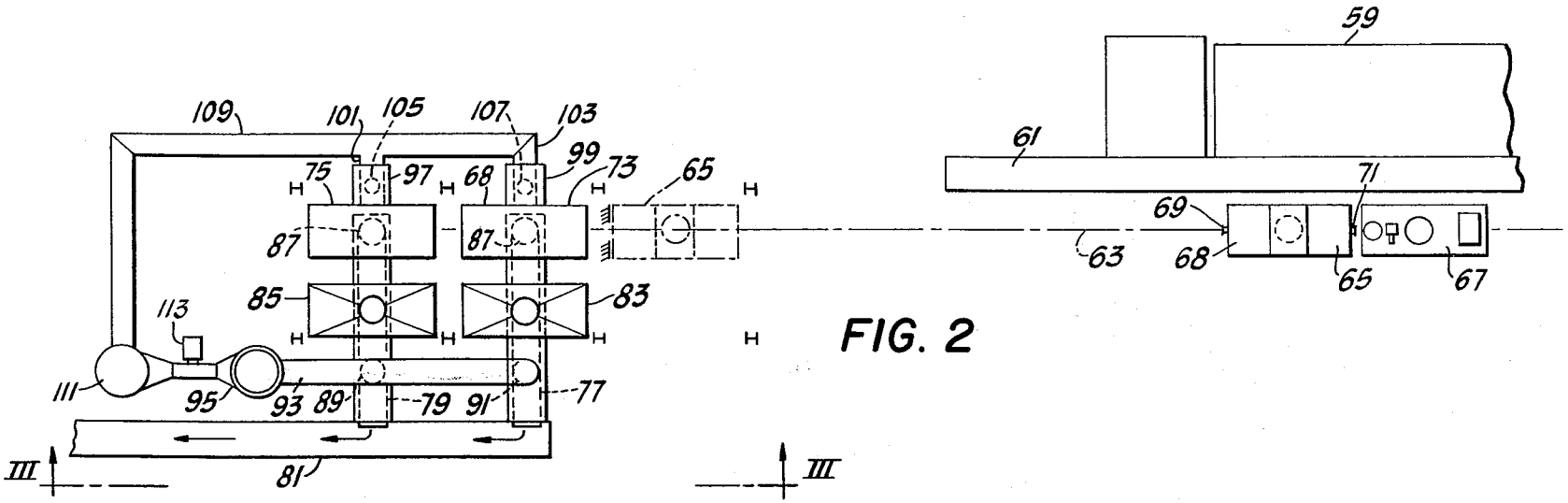
FIG. 2 is a schematic plan view of equipment in accordance with a second embodiment of the invention.

Referring to FIG. 2, a similar coke oven battery 59 is shown at the right-hand side of the drawing and alongside a bench portion 61 of the coke oven battery 59 is a single track 63 on which travels a coke transfer car 65 that is coupled to and movable with a gas scrubber car 67 having a traction drive. The transfer car comprises a removable hopper portion 68 and a frame and trucks 70.

The coke transfer car 65 is provided with lifting lugs 69, 71 so that the hopper portion 68 may be removed from the transfer car frame 70 and placed in position on one of a plurality of racks 73, 75 that are located over enclosed vibrating quench conveyors 77, 79. The enclosed vibrating quench conveyors 77, 79, like the conveyors 29, 31, 33 of FIG. 1, are disposed each in a pit below track level, and each one carries quenched coke toward a take-away conveyor 81 that moves the coke toward the left, as viewed in FIG. 2. Like the quench conveyors 29, 31, 33, the conveyors 77, 79 are each associated with water sprays (not shown) within the enclosure that quenches the coke on the conveyor.

Associated with the racks 73, 75 are two spare racks 83, 85. Each one of the racks 73, and 75, is disposed centrally about an adjustable sleeve 87 that communicates with one of the enclosed vibrating quench conveyors 77, 79.

Each enclosed vibrating quench conveyor 77, 79 has a tubular connection 89, 91, respectively, that conects a conduit 93 for carrying vapors into a stack 95. Fumes that issue from the incandescent coke, as it is being sprayed and cooled by water while traveling on the conveyors 77, 79, are collected in branch conduits 97, 99 that are telescopable with fixed conduits 101, 103. The branch conduits 97, 99 are movable from a retracted position, as shown in FIG. 2, to an operative position over the hopper portion 68 on its rack 73, and a sleeve portion 105, 107 of the branch conduits 97, 99 respectively, is positionable over the hopper portion 63 to catch fumes emanating through the hopper portion 68 from the quenched coke on the conveyors 77, 79.

The fumes travel in conduit 109 to a scrubber 111, and they are drawn therefrom by a motorized fan 113 and flow into the stack 95.

Figure 3:
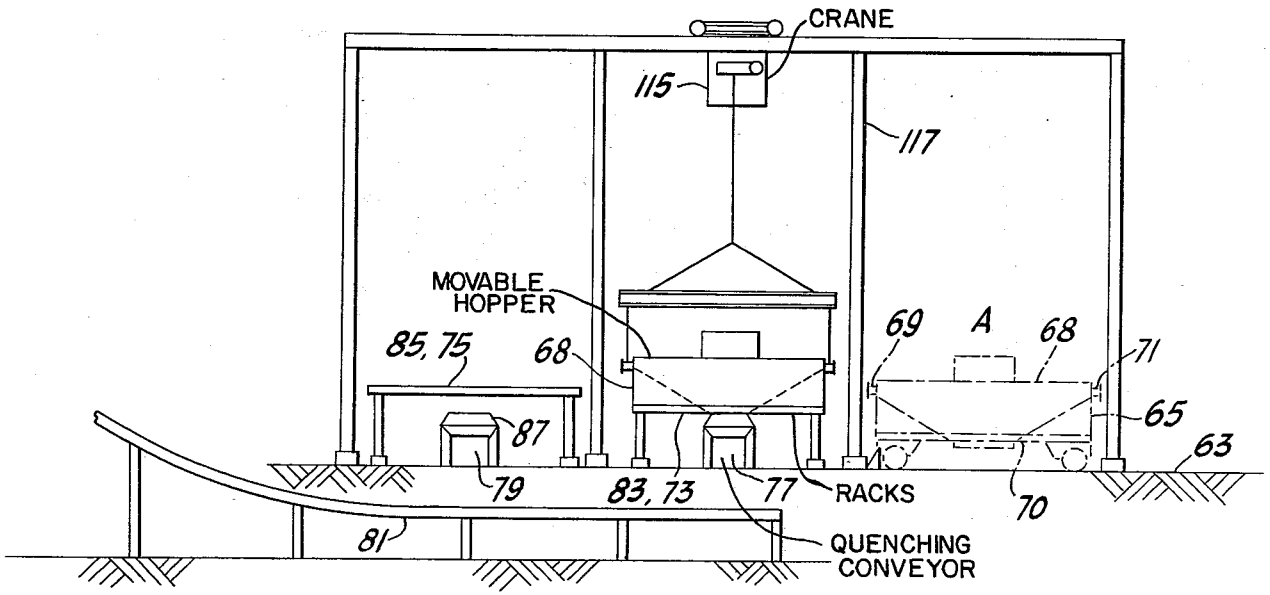
FIG. 3 is a view along line III—III of FIG. 2.

From FIG. 3 it will be noted that the hopper racks 73, 75 and 83, 85, as well as the conveyors 77, 79, are located beneath a bridge crane 115 and its supporting structure 117. The crane 115 is movable in two directions, parallel to the axis of the quench track 63 and laterally at right angles to such track. Thus the crane 115 can pick up a loaded hopper from the transfer car 65 at location A, and place it on any one of the four racks shown. The crane 115 also may pick up an empty hopper from any one of the racks and place it on the transfer car frame 70, which transfer car is then movable back to the coke oven battery to receive another load of coke.

Figure 4:
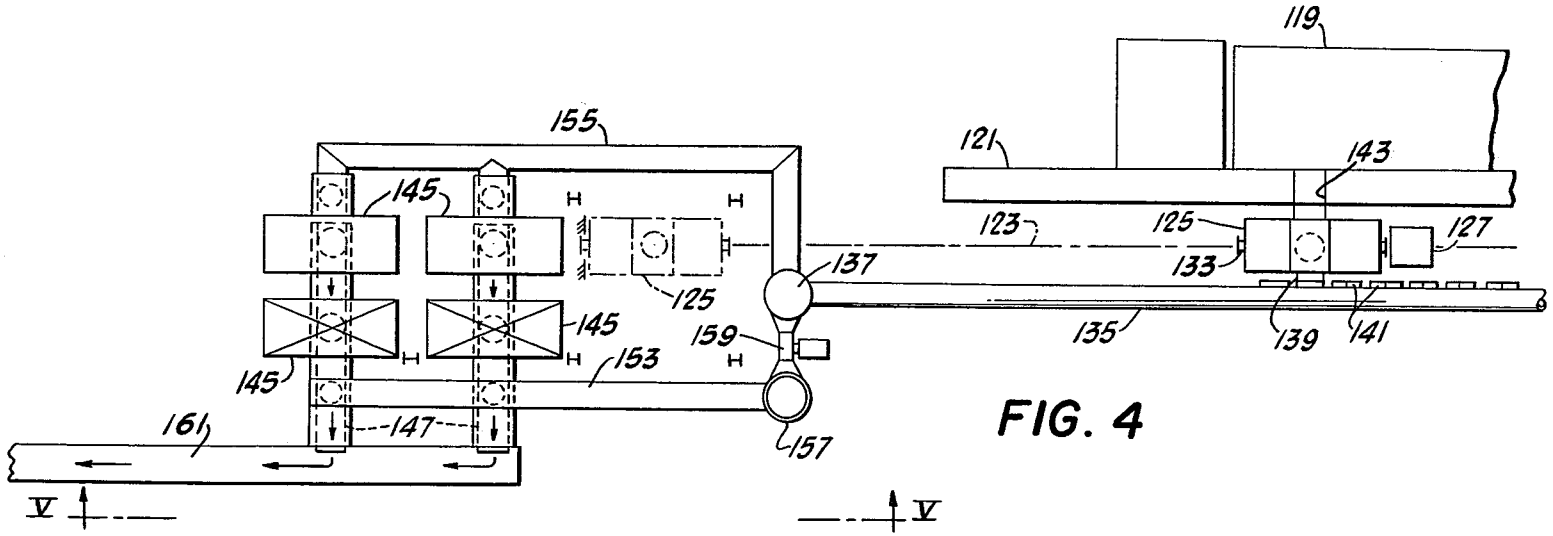
FIG. 4 is schematic plan view of equipment in accordance with a third embodiment of the invention.
Figure 5:
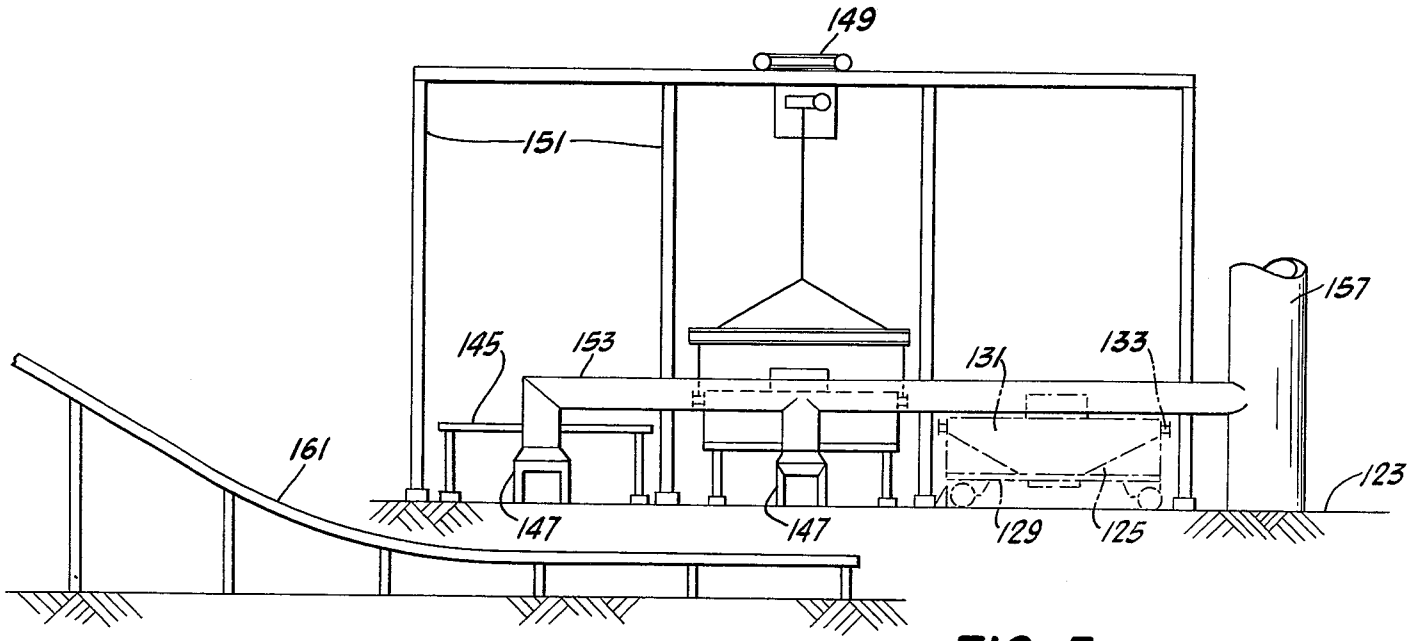
FIG. 5 is a view along line V—V of FIG. 4.

FIGS. 4 and 5 illustrate schematically another similar coke oven battery 119 and bench 121, alongside which there is a quench track 123 on which moves a coke transfer car 125. The coke transfer car 125 is propelled by a locomotive 127, and the car 125, like the car 65, is comprised of a frame and trucks portion 129 and a removable hopper portion 131 that is fitted with lifting lugs 133.

Adjacent to the locomotive 127 and the transfer car 125, but on the opposite side thereof from the coke oven bench 121, is a collecting main 135 that extends the full length of the coke oven battery (toward the right as viewed in FIG. 4) and it extends toward the left (as viewed in FIG. 4) to a gas scrubber 137. The collecting main 135 is fitted with a plurality of spaced apart covered openings 141, each opening being opposite a respective coke oven chamber of the battery 119. A coke guide and apparatus 143 for collecting and guiding effluent emitted while pushing coke, like that described and shown in copending application, Serial No. 170,926, filed August 11, 1971, is shown schematically in position to guide hot incandescent coke into the hopper portion 131 and to carry the fumes into the collecting main 135, through a fume conduit 139.

From FIG. 4 it will be noted that there are a plurality (four are shown) of hopper racks 145, like the hopper racks 73, 75, 83, 85 of FIG. 2, that are located above enclosed conveyors 147 and underneath a bridge crane 149 and crane supporting structure 151. Also, there is one conduit 153 that collects vapor from the conveyors, and one conduit 155 that collects fumes from the hoppers. The conduit 153 carries vapors into a stack 157, and the conduit 155, which is similar to the conduit 109 of FIG. 2, carries fumes into the gas scrubber 137, from which fumes are withdrawn and caused to flow into the stack 157 by means of a motorized fan 159.

The conveyors 147 cooperate with another conveyor 161, like the conveyor 81 of FIG. 2, that carries quenched coke to another location for further handling.

Figure 6:
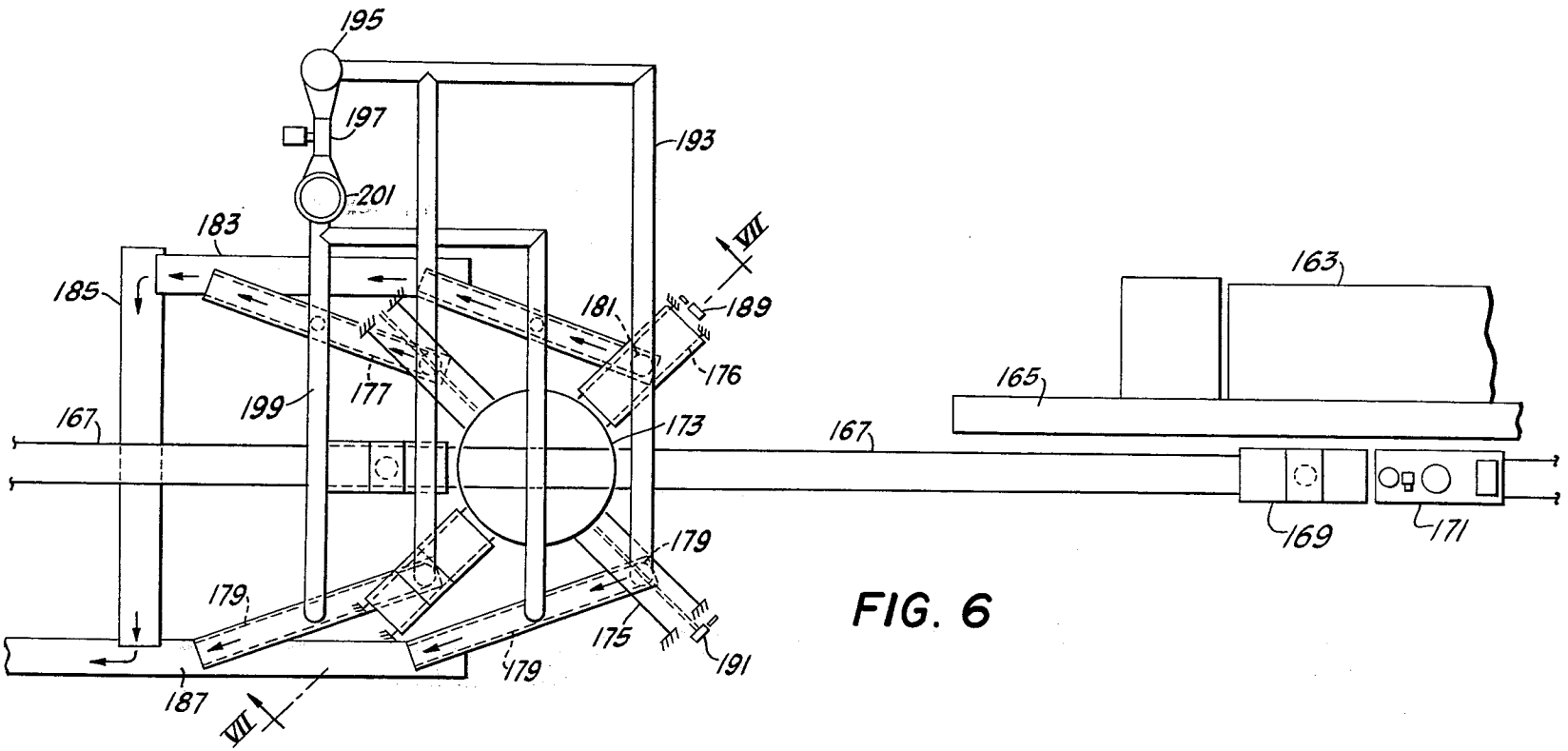
FIG. 6 is a schematic plan view of equipment in accordance with a fourth embodiment of the invention.
Figure 7:
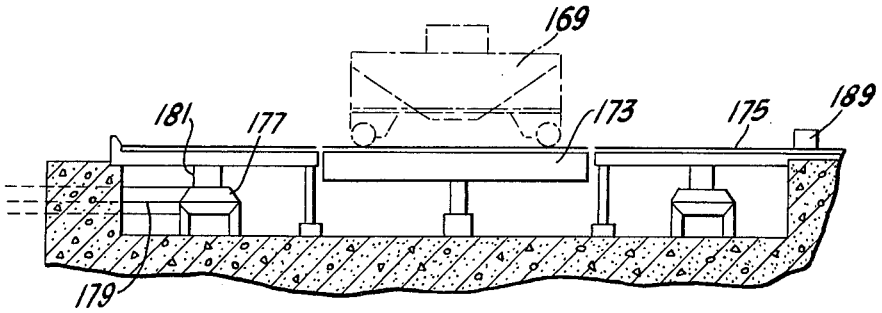
FIG. 7 is a view along line VII—VII of FIG. 6.

FIG. 6 illustrates schematically another embodiment of our invention wherein a conventional coke oven battery 163 is shown in part, and, alongside a bench portion 165 of such battery 163 there is a quenching car track 167 on which operates an enclosed coke transfer car 169, like the enclosed coke transfer car 15 of FIG. 1. A gas scrubber car 171 with traction drive, like the gas scrubber car 17 with traction drive of FIG. 1, is coupled to the transfer car 169.

As shown in FIG. 6, the quench track 167 extends some distance toward the left, to a conventional locomotive turntable 173. Associated with the turntable 173 are a plurality of radially extending track sections 175 (four such sections of tracks being shown). The quenching track 167 also extends past the turntable 173, as shown, and it may extend alongside another coke oven battery if desired.

Beneath each track section 175 there are enclosed quench conveyors 177, 179, like the conveyors 29, 31, 33 of FIG. 1, each one of which receives incandescent coke through an adjustable sleeve 181, that is similar to the sleeve 35 of FIG. 1. The enclosed quench conveyors 177 deposit coke on a transfer conveyor 183 that, in turn, deposits the coke on another transfer conveyor 185. From the conveyor 185 the coke passes onto a take-away conveyor 187 onto which the conveyors 179 also deposit coke.

From FIG. 6 it will be seen that two of the radially extending track sections 175 and 176 are provided with a conventional car puller mechanism 189, 191 by means of which the coke transfer car 169 can be positioned on these sections of track. Further, these particular sections of track may have a very slight up-grade whereby the coke transfer car 169 will gravitate down to the turntable 173 after the transfer car 169 is empty.

Like the conveyor and transfer car arrangement shown in FIG. 1, a fume main 193, scrubber 195, motorized fan 197, vapor main 199, and stack 201 are located about where shown in FIG. 6. Each such unit is disposed for the purpose described in connection with the same apparatus of FIG. 1.

Figure 9:
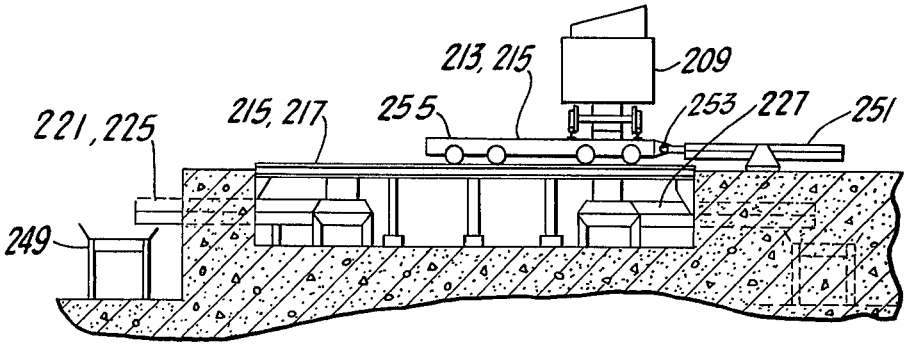
FIG. 9 is a view along line IX—IX of FIG. 8.
Figure 8:
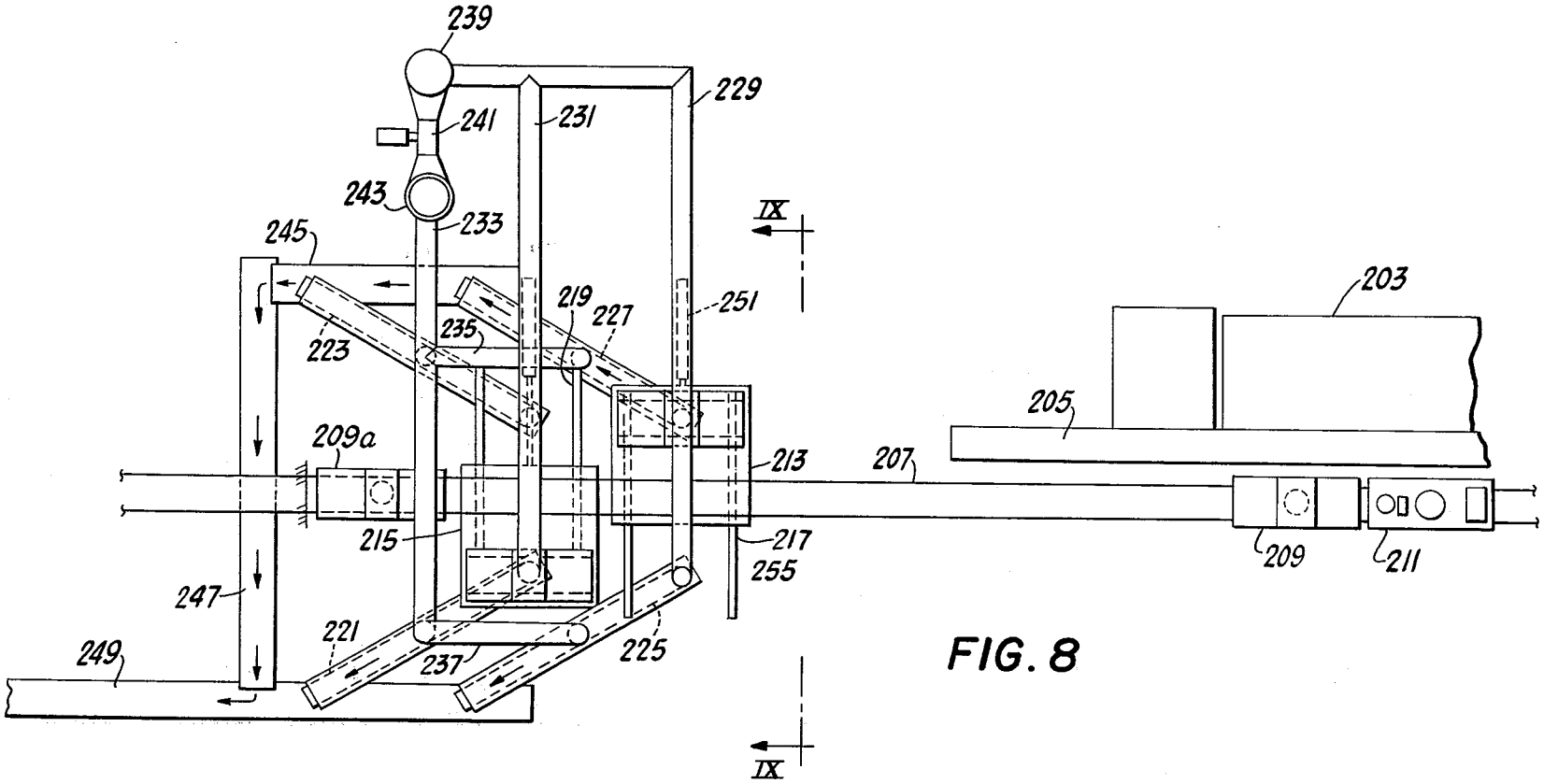
FIG. 8 is a schematic plan view of equipment in accordance with a fifth embodiment of the invention.

Referring to FIGS. 8 and 9, there is shown alongside a conventional coke oven battery 203, a bench 205 and a coke quenching car track 207 on which an enclosed coke transfer car 209 and scrubber car 211 with traction drive operate.

The coke quenching car track 207 extends toward the left, as viewed in FIG. 8, to an area where there is located transfer tables 213, 215 that are laterally movable, with respect to the track 207 and tracks 217, 219.

Associated with the transfer table 215 are two angularly disposed enclosed coke conveyors 221 and 223, that are like the conveyors 177, 179 of FIG. 6. Two other angularly diposed enclosed coke conveyors 225, 227, like the conveyors 177, 179 of FIG. 6, are associated with the transfer table 213.

Also, the equipment associated with the transfer tables 213, 215 includes two fume mains 229, 231, vapor mains 233, 235, 237, a scrubber 239, a motorized fan 241, and a stack 243. This equipment functions like the same equipment described previously in connection with both FIG. 6 and FIG. 1. The conveyors 227, 223 deposit quenched coke on another conveyor 245 that deposits the coke on yet another conveyor 247. From the conveyor 247, the coke gravitates onto a take-away conveyor 249 onto which coke from the conveyors 221, 225 also gravitates.

Beyond the transfer tables 213, 215, there is room on the extended quenching car track 207, to store a spare coke transfer car **209*a*, and the quenching car track 207 extends further toward the left, as viewed in FIG. 8**, as a possible through-track alongside another coke oven battery.

As shown in FIG. 9, a fluid-actuated, cylinder-piston assembly 251 pin connected, as at 253, to each transfer table 213, 215 for moving the transfer tables laterally. Also, there is a short section of track 255 on each transfer table 213, 215, not occupied by the coke transfer car 209. Those skilled in the art will understand that other means, such as rack and pinion, electric wheel drive and the like, may be used to move the transfer tables 213, 215 laterally, instead of the cylinder-piston assembly 251 shown in FIG. 9, if such other means is preferred.

Figure 10:
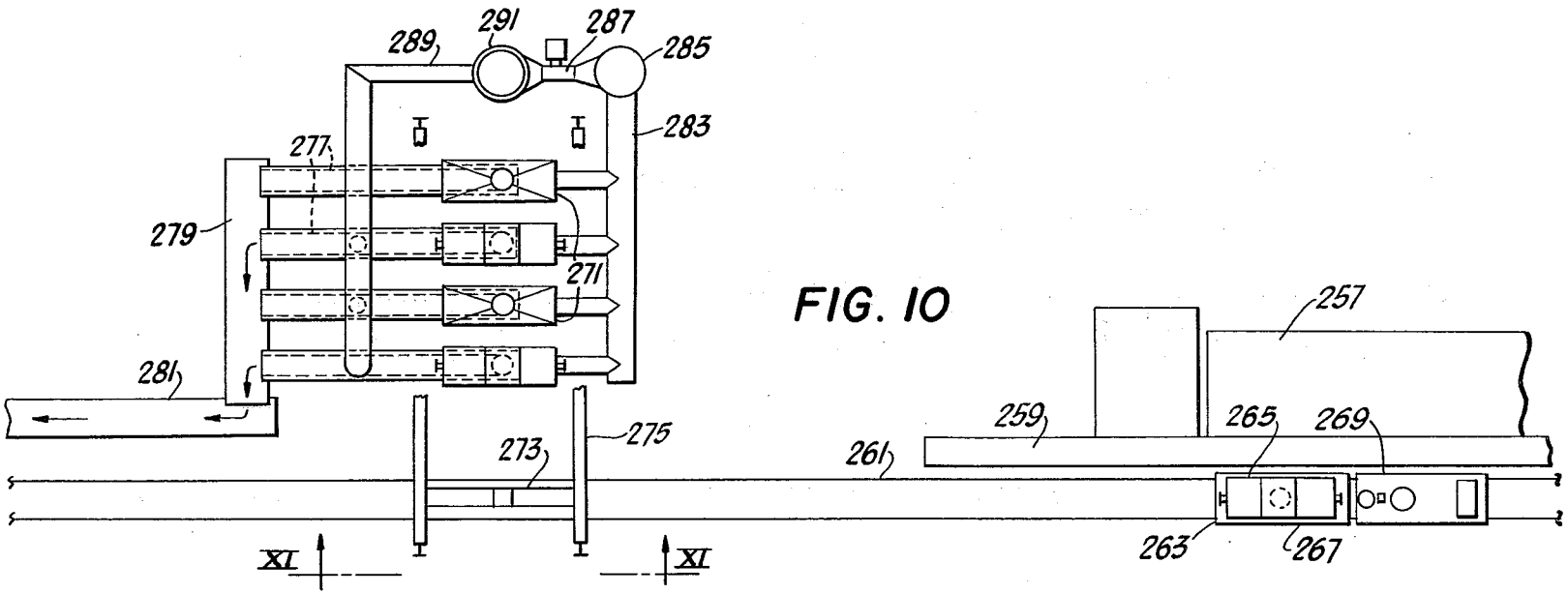
FIG. 10 is a schematic plan view of equipment in accordance with a sixth embodiment of the invention.
Figure 11:
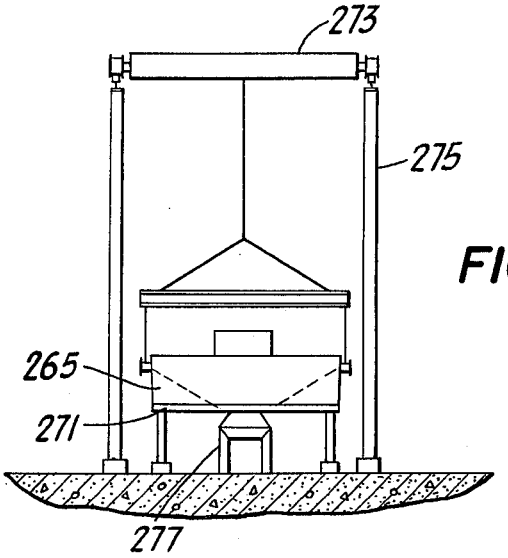
FIG. 11 is a view along line XI—XI of FIG. 10.

Referring to FIGS. 10 and 11, a conventional coke oven battery 257 is shown and alongside the bench portion 259 of the battery is a quenching car track 261. On the track 261 are a coke transfer car 263 with a removable hopper 265 mounted onto a frame portion 267, and a gas scrubber car 269 with traction drive. The coke transfer car 263 is similar to the coke transfer car 65 shown in FIG. 2 and described herein. The gas scrubber car 269 is similar also to the gas scrubber car 67 shown in FIG. 2 and described herein.

The quenching car track 261 extends toward the left, as viewed in FIG. 10, to an area where there is located a plurality of hopper racks 271, which are like the hopper racks 73, 75, 83, 85 shown in FIGS. 2 and 3 and described herein. The arrangement of the hopper racks 271 is slightly different from the arrangement of the racks shown in FIG. 2; the racks 271 being in a side-by-side, parallel orientation.

Associated with the hopper racks 271 is a bridge crane 273 that is mounted on supporting structure 275 above the several hopper racks 271. The bridge crane 273 is used to transfer the loaded hopper portion 265 from the transfer car frame portion 267 to one of the empty hopper racks 271.

Like the arrangement of the hopper racks shown in FIGS. 2 and 4, the hopper racks 271 are associated with individual enclosed quench conveyors 277 that carry coke to and that deposit coke on a transverse conveyor 279. The coke on the transverse conveyor gravitates onto a take-away conveyor 281 that is similar to the take-away conveyors 81, 161 of FIGS. 2 and 4.

Associated with the hopper rack 271 and conveyor 277, 279, 281, shown in FIG. 10, are a fume main 283, which carries gases to a gas scrubber 285, a motorized fan 287, and a vapor main 289 that carries vapors from the conveyors 277 to a stack 291. The various mains, stack, scrubber and motorized fan are like the same equipment shown in FIG. 2 and described herein.

Those skilled in the art will recognize that many of the functions of the apparatus shown and described in the several systems for quenching coke may be fully, or to a large degree, automated, and control of the operations may be carried out by remote control means of a type known to those skilled in the art.

From the foregoing description of various embodiments of the invention, those skilled in the art should recognize many important features and advantages thereof.

Among the features and advantages that are found in the present invention, the following are particularly significant:

That the incandescent coke is quenched in an enclosed environment and all fumes that are emitted as a result of quenching are cleaned and scrubbed before they are released to an exhaust stack;

That several batches of coke from different oven chambers can be quenched simultaneously, whereby, quenched coke is delivered to a furnace or to storage practically continually;

That the coke quenching apparatus of some embodiments of our invention is available for use simultaneously by quenching cars from two or more coke oven batteries; and That the apparatus of the invention for quenching coke may be fully automated or automated to a large degree whereby there is considerable economy in the use of such systems as are described herein.

Although the invention has been described herein with a certain degree of particularity, it is understood that the present disclosure has been made only as an example and that the scope of the invention is defined by what is hereinafter claimed.

What is claimed is:

1. In a coke oven battery, the improved coke quenching system comprising:

a. a quenching car track disposed alongside said battery and extending therefrom to a remote location relative to said battery;

b. a hopper removably mounted to a frame that is movable on said track, said hopper being adapted for receiving incandescent pushed coke from said battery;

c. means for moving said frame and hopper along said track to said remote location;

d. plural racks disposed at said remote location for supporting said hopper;

e. plural conveyor means disposed relative to said plural racks respectively;

f. means for transferring and selectively positioning said hopper on a single rack overlying a respective single conveyor;

g. means for discharging coke from said hopper onto said respective conveyor;

h. means for quenching said incandescent coke on said plural conveyor means;

i. means for collecting fumes from said hopper at said location as said coke is discharged therefrom onto said respective single conveyor;

j. means for collecting vapors from the environment surrounding said plural conveyor means;

k. means for conducting said fumes into a fume cleaning device and for discharging the cleaned fumes to atmosphere;

l. means for conducting said vapors into apparatus that discharges said vapors to atmosphere; and m. further conveyor means for removing and carrying away said coke from said plural conveyors after said coke is quenched.

2. The system of claim 1 including:

a. adjustable sleeve means for cooperating with said coke receiving means to carry said coke onto said plural conveyor means.

3. The system of claim 1 including:

a. crane means for removing said hopper from said single frame and placing said hopper on said rack.

4. In a coke oven battery, the improvement comprising:

a. a quenching car track disposed alongside said battery and extending therefrom to a remote location relative to said battery;

b. coke receiving means on said track for receiving incandescent coke pushed from said battery;

c. means for moving said coke receiving means on said track;

d. a collecting main for gases extending along the battery and communicating with a stack at said remote location;

e. means communicating with said coke receiving means and said collecting main for conveying gases arising from said coke in said receiving means into said collecting main;

f. plural support means disposed at said remote location for supporting said coke receiving means;

g. crane means for transferring and selectively positioning said coke receiving means from said track to a single one of said plural support means;

h. plural conveyor means disposed relative to said plural support means for receiving coke discharged from said coke receiving means;

i. means for discharging coke from said coke receiving means onto a respective conveyor means;

j. other conveyor means for receiving and carrying away said coke from said plural conveyor means;

k. conduit means at said remote location for receiving and conducting gases away from said plural conveyor means to and into said stack; and l. conduit means at said remote location communicating with and carrying gases from said coke receiving means at said location into said stack.

* * * * *